US007650996B2

(12) United States Patent
Mark

(10) Patent No.: US 7,650,996 B2
(45) Date of Patent: Jan. 26, 2010

(54) PRODUCT PACKAGING WITH COLLAPSIBLE PROTECTIVE LID

(75) Inventor: Michelle Mark, Hermosa Beach, CA (US)

(73) Assignee: Mattel, Inc., El Segundo, CA (US)

( * ) Notice: Subject to any disclaimer, the term of this patent is extended or adjusted under 35 U.S.C. 154(b) by 335 days.

(21) Appl. No.: 11/438,937

(22) Filed: May 22, 2006

(65) Prior Publication Data

US 2006/0283775 A1 Dec. 21, 2006

Related U.S. Application Data

(60) Provisional application No. 60/686,655, filed on Jun. 1, 2005.

(51) Int. Cl.
*B65D 25/54* (2006.01)
*B65D 5/00* (2006.01)
*B65D 5/38* (2006.01)

(52) U.S. Cl. ..... 206/774; 206/772; 206/775; 229/125.125; 229/129; 229/141

(58) Field of Classification Search ..... 206/736, 206/45.2, 45.23, 762, 769, 774, 781, 457, 206/777, 772, 775; 229/126–129.1, 141–154, 229/125.125; 446/72–76
See application file for complete search history.

(56) References Cited

U.S. PATENT DOCUMENTS

| | | | | |
|---|---|---|---|---|
| 1,143,729 | A | 6/1915 | Schmidt | |
| 1,364,277 | A | 1/1921 | Heyden | |
| 1,566,523 | A | 12/1925 | Coffey | |
| 1,682,449 | A * | 8/1928 | Vest | 229/125.125 |
| 1,740,550 | A * | 12/1929 | Michelin | 229/153 |
| 1,787,499 | A * | 1/1931 | Tinsley | 206/45.29 |
| 2,023,242 | A * | 12/1935 | Ringler | 206/45.2 |
| 2,167,691 | A | 8/1939 | Shoemaker et al. | |
| 2,405,862 | A | 8/1946 | Toomey | |
| 2,409,187 | A | 10/1946 | Bower | |
| 2,723,747 | A * | 11/1955 | Oxenfeld | 206/777 |
| 2,748,928 | A * | 6/1956 | Stavis et. al. | 206/762 |
| 2,936,944 | A * | 5/1960 | Arlington | 229/125.125 |
| 3,434,645 | A | 3/1969 | Prisco | |
| 3,885,668 | A * | 5/1975 | McClain | 206/561 |
| 4,234,079 | A * | 11/1980 | Otake | 206/457 |
| 4,326,665 | A | 4/1982 | Scott | |
| 4,391,386 | A | 7/1983 | Moret | |
| 4,411,382 | A | 10/1983 | Taub | |
| 4,418,497 | A | 12/1983 | Mastriano | |
| 4,441,625 | A | 4/1984 | Andersson | |
| 4,700,831 | A | 10/1987 | Kassai | |
| 4,712,726 | A | 12/1987 | Fonas | |

(Continued)

FOREIGN PATENT DOCUMENTS

| | | |
|---|---|---|
| EP | 1621469 | 2/2006 |

(Continued)

*Primary Examiner*—Bryon P Gehman
(74) *Attorney, Agent, or Firm*—Kolisch Hartwell, P.C.

(57) ABSTRACT

A product packaging system is provided including a receptacle having an opening to a compartment and a collapsible cover that may be configured to enclose product components within the receptacle. In some embodiments, the collapsible cover takes the form of a folded panel configured to extend across one or more compartments of the receptacle.

19 Claims, 4 Drawing Sheets

U.S. PATENT DOCUMENTS 4,750,609 A * 6/1988 Felis ..... 229/141
4,813,382 A 3/1989 Lindermann et al.
4,813,536 A 3/1989 Willis
4,930,903 A 6/1990 Mahoney
5,038,930 A 8/1991 Holtkamp, Jr.
5,078,268 A 1/1992 Olson et al.
5,158,809 A 10/1992 Proctor
5,222,657 A 6/1993 Holland, Jr.
5,226,532 A 7/1993 Davidson
5,245,815 A 9/1993 Savage
5,263,635 A * 11/1993 Fitzgerald ..... 229/149
5,289,917 A 3/1994 Chabria
5,392,983 A 2/1995 Clarke et al.
5,433,317 A 7/1995 Roser
5,454,471 A * 10/1995 Norvell ..... 229/154
5,456,062 A 10/1995 Wechsler
5,458,235 A 10/1995 Stone
5,494,214 A * 2/1996 Fleury et al. ..... 229/149
5,497,876 A 3/1996 Fleming
5,575,384 A 11/1996 Saye
5,586,659 A 12/1996 Trumbo
5,641,062 A 6/1997 Burton et al.
5,743,458 A 4/1998 French
5,794,631 A 8/1998 Sylvester
5,855,499 A 1/1999 Yamazaki
5,860,589 A 1/1999 Hsu
5,904,289 A 5/1999 Hagan
5,934,548 A 8/1999 Kenyon
5,984,755 A * 11/1999 Avey ..... 446/75
6,012,842 A 1/2000 Openiano
6,021,941 A 2/2000 Schultz
6,070,719 A 6/2000 Pollock
6,115,999 A 9/2000 Adelman
6,244,439 B1 6/2001 Dennis
6,305,539 B1 * 10/2001 Sanders, Jr. ..... 206/320
6,319,087 B1 * 11/2001 Ferrigno ..... 446/73
6,371,366 B1 4/2002 Edgerton et al.
6,659,271 B2 12/2003 Parsons
6,692,091 B2 * 2/2004 Mulaw ..... 312/245
6,702,108 B2 3/2004 Lo
6,725,587 B2 4/2004 Collins
6,823,988 B2 11/2004 Ryan et al.
6,868,964 B2 3/2005 Carty et al.
6,874,678 B2 4/2005 Prokosch et al.
6,981,589 B2 * 1/2006 Sanders, Jr. ..... 206/320
D516,421 S 3/2006 Girondi et al.
2002/0112448 A1 8/2002 Fisher
2003/0173238 A1 9/2003 Lo
2003/0226880 A1 12/2003 Lo
2003/0230501 A1 12/2003 Smolev
2004/0011858 A1 1/2004 Lo
2004/0026488 A1 2/2004 Beach
2004/0149601 A1 8/2004 Carty
2004/0149622 A1 8/2004 Kwong
2005/0055854 A1 3/2005 Collins
2005/0087469 A1 4/2005 Carty
2005/0167319 A1 8/2005 Girondi
2006/0021906 A1 2/2006 Gillon

FOREIGN PATENT DOCUMENTS

GB 437438 10/1935
WO 9906287 2/1999
WO 0064762 11/2000
WO 0241166 5/2002
WO WO 03/094823 11/2003
WO 2004071881 8/2004
WO 2005023681 3/2005
WO 2005042265 5/2005

* cited by examiner

PRODUCT PACKAGING WITH COLLAPSIBLE PROTECTIVE LID

CROSS-REFERENCE TO RELATED APPLICATIONS

This application claims priority under 35 U.S.C. 119(e) to U.S. Provisional Patent Application No. 60/686,655 entitled "PRODUCT PACKAGING WITH COLLAPSIBLE PROTECTIVE LID," filed Jun. 1, 2005, the disclosure of which is incorporated herein by reference.

BACKGROUND

The present disclosure relates to product packaging, and more specifically to packaging that may continue to be useful to a consumer to protect and store the enclosed product after it has been purchased. Although numerous packaging designs are available for product shipment and retail display, the utility of these packaging configurations is typically exhausted once the product is purchased. Examples of packaging for product shipment and retail display are disclosed in U.S. Pat. Nos. 4,411,382, 4,813,382, 5,855,499, 6,012,842, the disclosures of which are incorporated herein by reference.

SUMMARY

The present disclosure relates generally to a product packaging system that protects and stores a product after the product has been purchased by a consumer. More specifically, it relates to packaging that includes a collapsible portion that may be configured to enclose a product within the packaging.

The advantages of the disclosed packaging system may be understood more readily after a consideration of the drawings and the Detailed Description.

DETAILED DESCRIPTION

Figure 1:
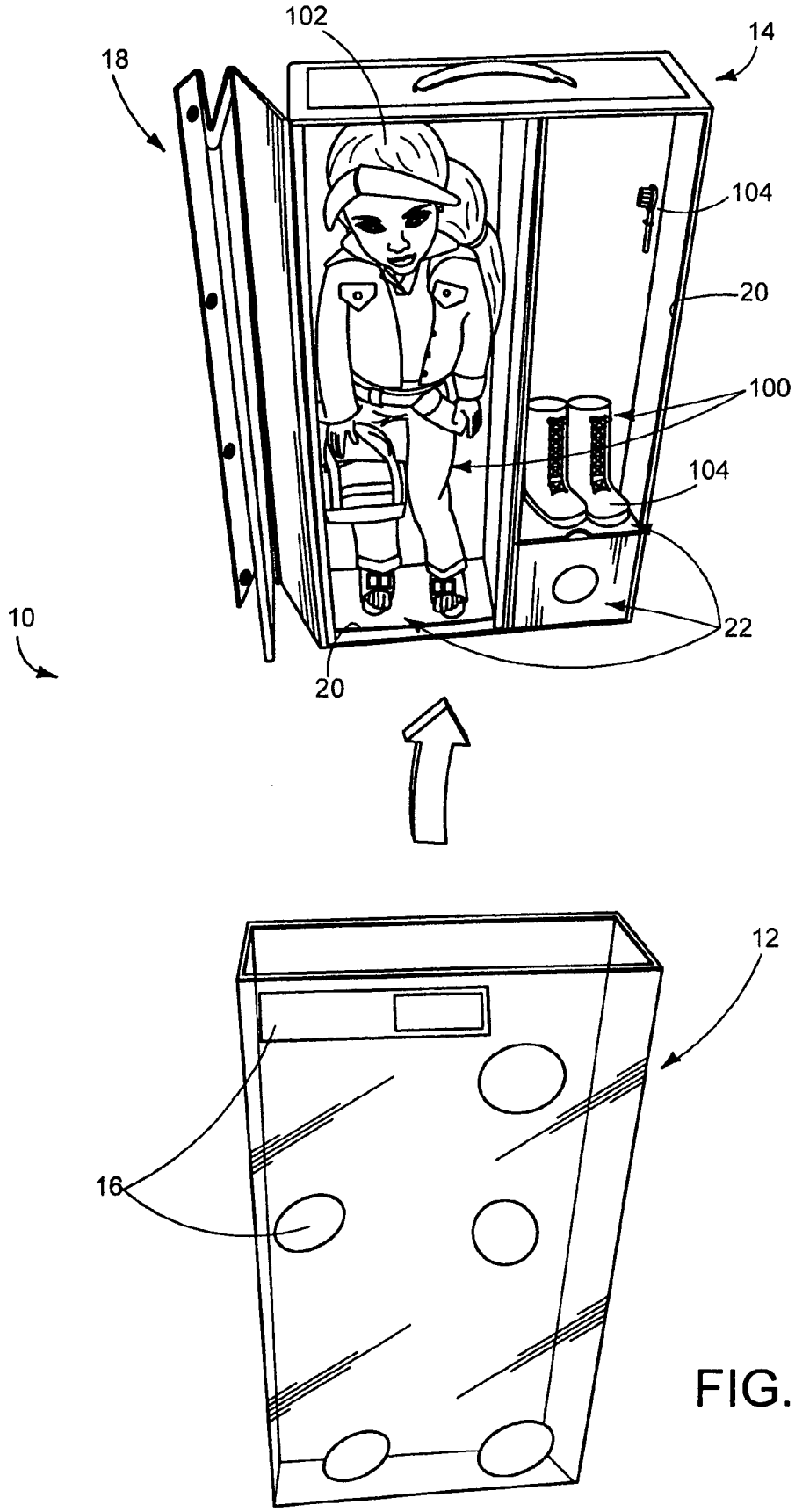
FIG. 1 is an exploded view of a packaging system including a disposable cover and a receptacle having a protective cover configured to fold.

Product packaging systems may be configured to protect and store enclosed products after the products have been purchased. Referring to FIG. 1, products and their components 100 may be placed in packaging system 10 for transport, storage, and display. Products 100 may include any consumer product. In the illustrative example shown in FIG. 1, product 100 includes a doll 102 and accessories 104 appropriate for a doll. The disclosed packaging system 10 may be configured to enclose any product that a consumer may wish to protect from trauma, environmental factors, and other sources of damage. Packaging system 10 may provide a way of keeping the product components in one location to guard against loss.

As shown in FIG. 1, product 100 may be marketed and sold in product packaging system 10. Packaging system 10 may include a primary or disposable cover 12, such as a plastic cover, that protects the product and other packaging components during shipment and retail display until a consumer has purchased the product. Disposable cover 12 may slide over a product receptacle 14 that houses product 100. Disposable cover 12 may provide a surface to affix labels 16 for advertisements and pricing information.

A consumer may wish to retain a way of enclosing the product in its packaging after disposable cover 12 has been discarded. Consequently, packaging system 10 may include a secondary cover 18 that acts in cooperation with product receptacle 14 to form a storage system. Secondary cover 18 may function in place of the disposable cover for continued or additional shipment or display, long-term storage, or short-term storage, such as by providing a suitable location for a child to place his or her toys so that the child's room appears tidy.

Receptacle 14 may take the form of a box or other suitable storage structure. The receptacle may be formed of any suitable material, including, but not limited to cardboard, metal, plastic, and the like.

Receptacle 14 may include at least one opening 20. Opening 20 may provide access to a compartment 22. A receptacle may include a plurality of compartments and a plurality of corresponding openings. The openings to multiple compartments may be on one or more sides of the receptacles. In the exemplary receptacle shown in FIGS. 1-3, the openings are located on the front of the receptacle. However, in the example shown in FIG. 6, openings 20 pass through the front and right sides of the receptacle. Some compartments may have openings on different sides of the receptacle relative to the other compartment openings.

Figure 2:
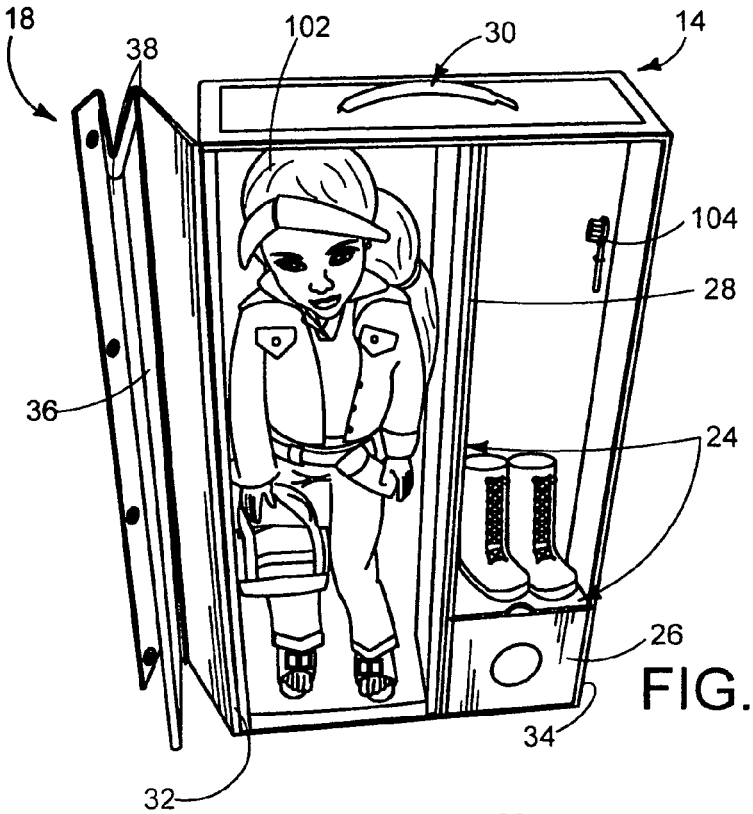
FIG. 2 is a perspective view of the receptacle of FIG. 1 showing the protective cover in an open configuration.
Figure 3:
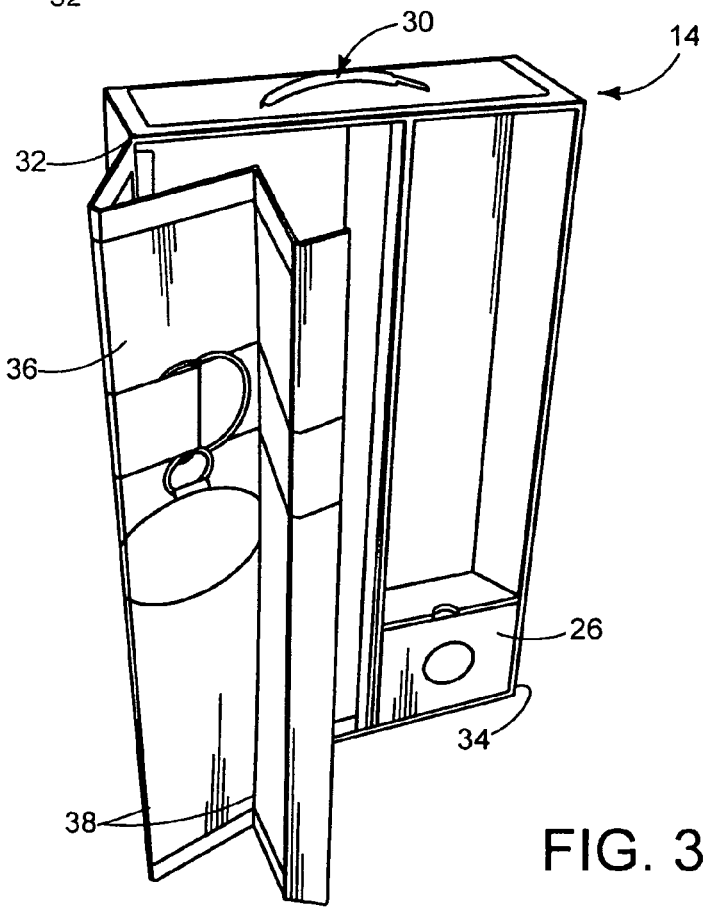
FIG. 3 illustrates the protective cover of FIG. 2 being extended across openings of compartments in the receptacle.

As illustrated in FIG. 2, receptacle 14 may include a variety of dividers 24 that separate the receptacle into two or more compartments 22. For example, dividers 24 may include one or more drawers 26 and other inserts 28, such as shelving inserts, that may be removable. In some versions of the packaging system, the dividers may be integrally formed with receptacle 14.

Compartments 22 may be configured to house one or more products and/or product components, such as a toy 102 and the accompanying toy accessories 104. Toy 102 and accessories 104 may be in the form of a gun and ammunition, a car and trim or wheel options, a soldier and weapons, a figure and accessories, a doll and clothing, and the like. Packaging system 10 may be decorative or include other features that relate to the enclosed product. For example, where the toy is a doll as shown in FIGS. 1-5, packaging system 10 resembles a closet or wardrobe configured to store a doll and doll clothing.

Receptacle 14 may include a handle 30 of any configuration suitable for grasping by a consumer. Handle 30 may be integrally or separately formed with other portions of the receptacle. The handle may extend from any suitable location on the receptacle, such as from the top, the left side, or the right side.

Secondary cover 18 may take any suitable form that extends across an opening 20 for any one or more of compartments 22. For example, secondary cover 18 may take the form of one or more collapsible panels that extend across openings 20 in the receptacle to take the place of the disposable cover. In configurations in which receptacle 14 resembles a box, protective cover 18 may form a lid to the box. The secondary cover may be unattached to the receptacle, attached at one or more locations to the receptacle, or integrally formed with a portion of the receptacle.

Secondary cover 18 may be coupled to the receptacle at a first, or anchor, location 32. The secondary cover may move between an open configuration or orientation and a closed configuration or orientation, in which the secondary cover is coupled to the receptacle at a second, or attachment, location 34. In the open configuration, the secondary cover may be collapsed substantially adjacent the first location with the opening fully accessible. In the closed configuration, the secondary cover may be extended across one or more of the compartment openings. Where secondary cover 18 is a lid to a box, the lid may be stored on any appropriate surface, such as a rear surface of receptacle 14.

In the illustrative example shown in FIGS. 2-5, secondary cover 18 may be configured to extend across or otherwise enclose any combination of compartments 22. For example, a single panel may be configured to extend across an entire side of the packaging, such as that shown in FIGS. 2-5. In some examples of packaging system 10, the secondary cover may be configured to extend incrementally, such as half way across a side of the package, thereby only enclosing one of compartments 22. In such a configuration, a consumer may continue to use the product components stored in the uncovered compartments while still protecting the remainder of the product components.

As previously noted, secondary cover 18 may be collapsible and/or multi-segmented. An illustrative example of such a configuration is shown in FIGS. 2-5. As shown, secondary cover 18 may be a collapsible panel 36 configured to fold in an accordion-like fashion, similar to that of a closet door, to enclose, and thereby protect, a product housed within the receptacle. Collapsible panel 36 may have creases 38 to facilitate folding of the panel into these accordion fold sections.

Secondary cover 18 may be a flexible structure, such as by folds, joints, or an elastic border. The secondary cover may be formed of any suitable material, including, but not limited to cardboard, metal, plastic, elastic materials, and the like. In some configurations, the secondary cover is opaque, transparent, or decorated with artistic renderings.

As illustrated in FIGS. 2-5, receptacle 14 may take the form of a box with secondary cover 18 taking the form of a lid. The lid may be coupled to a first side of the box and have accordion folds. The lid may be creased between the multiple segments so that the segments are configured to fold against one another in alternating directions. The lid may further be configured to removably couple to a second side of the box and move between a closed orientation in which the lid is extended across the opening and an open orientation, approximately perpendicular to the closed orientation, in which the lid is collapsed and stored against the first side of the box.

Figure 4:
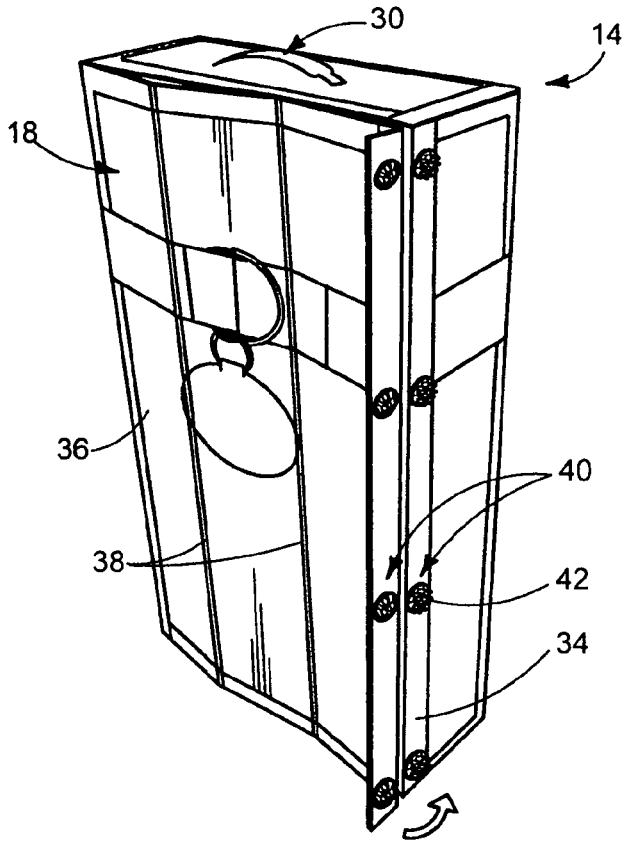
FIG. 4 illustrates coupling of the protective cover of FIG. 3 to the receptacle.

Secondary cover 18 may be permanently coupled to a portion of the packaging or may be completely detachable, although it is preferred that the panel be permanently joined to prevent loss or damage of the cover. As illustrated in FIG. 4, secondary cover 18 may include fastening mechanisms 40 to removably couple the panel to the receptacle at the second location, and thereby secure the panel across the opening of one or more compartments. Fastening mechanisms 40 may be configured to retain secondary cover 18 in an open position, a closed position, an intermediate attachment location, to couple secondary cover 18 to receptacle 14 at anchor location 32, or any combination thereof.

Figure 5:
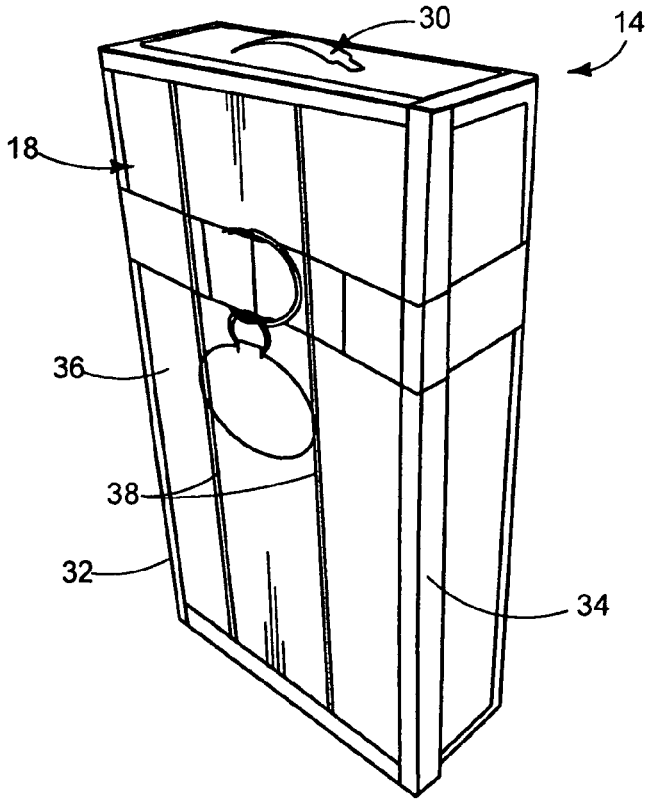
FIG. 5 is a perspective view of the receptacle of FIG. 1 showing the protective cover in a closed configuration.

Fastening mechanisms 40 may include chemical adhesives, mechanical fasteners, including but not limited to clasps, snaps, and insert tabs, or a combination thereof. As shown in the example of FIG. 4, the fastening mechanism consists of several sections of hook-and-loop closure type fasteners 42, namely, pieces of Velcro, that mate to an edge of the packaging opposite the edge from which the panel extends. Fastening mechanisms 40 may therefore retain secondary cover 18 in the closed configuration, as illustrated in FIG. 5.

In some configurations, secondary cover 18 may roll around itself, stretch, telescope, or provide for any other suitable method of decreasing its size when in the open configuration. For example, in the configuration shown in FIG. 6, secondary cover 18 takes the form of a collapsible panel 36' that is configured to roll. Anchor location 32 may therefore include a dowel or other support structure for panel 36'. Springs or other biasing mechanisms may be mounted at the anchor location to bias the panel to the open configuration.

Receptacle 14 may include openings 20 on two or more sides, such as the front and the right side of the receptacle. In the configuration shown in FIG. 6, fastening mechanisms 40 take the form of hooks 44 that are received by catches 46. Any suitable quantity of hooks and catches may be provided. Catches 46 may be provided at several locations, such as along a front edge opposite anchor location 32 and along a rear edge at attachment location 34.

Figure 6:
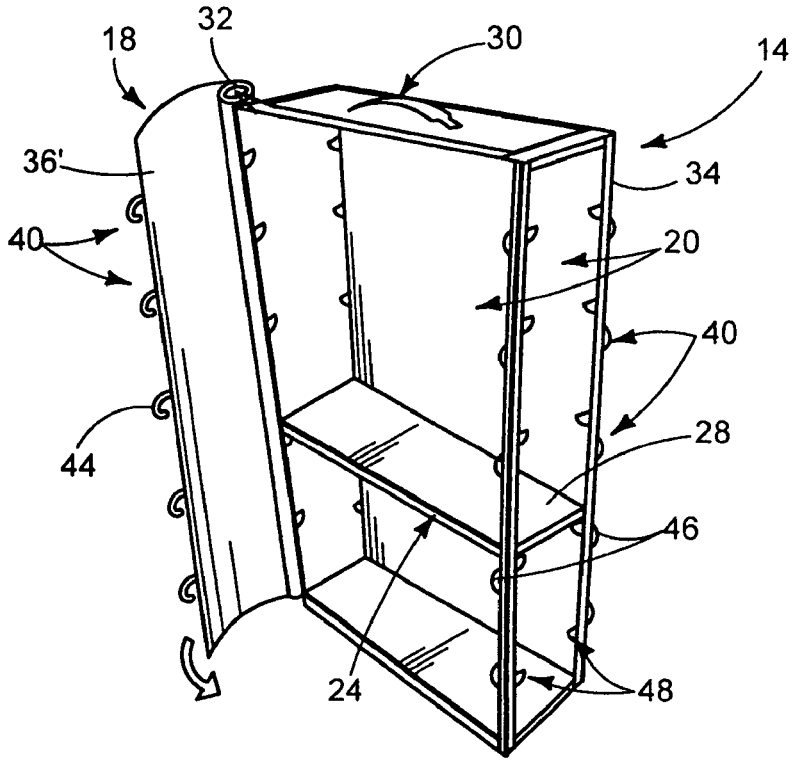
FIG. 6 illustrates an example of a receptacle having a protective cover configured to roll.

In one example, the configuration of the receptacle can be configured by the user after purchase. For example, as shown in FIG. 6, removable inserts 28 may be placed across a variety of shelf supports 48 to provide a compartment configuration that meets a consumer's needs.

Figure 7:
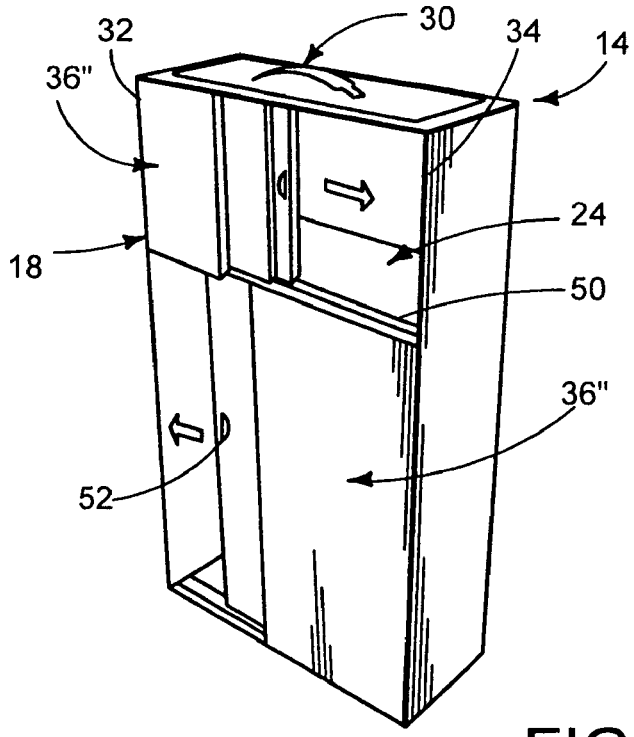
FIG. 7 illustrates an example of a receptacle having a protective cover configured to slide.

In some versions of the packaging system, secondary cover 18 may be configured to incrementally extend across multiple openings. For example, as shown in FIG. 7, secondary cover 18 may take the form of a collapsible panel 36" configured to slide. The panel may slide on rails 50 or any other suitable retaining structure. More than one secondary cover may be provided so that separate compartments within receptacle 14 have separate secondary covers or cover combinations. Multiple collapsible panels may therefore extend across openings to multiple compartments as shown in FIG. 7.

Panels 36" may include handles 52 to assist a consumer in manipulating the panels to access the compartments. As shown in the exemplary configuration of FIG. 7, handles 52 may take the form of detents in which a consumer rests his or her finger to slide the panels.

The collapsible panel may be biased to a particular configuration. For example, elastic strips may connect the edges of the folded sections so that the collapsible panel is biased to the open configuration. Panels that are retained as a roll, such as previously discussed with reference to FIG. 6, may include springs to bias the panel to the open configuration in which the panel remains rolled around a dowel or other support structure.

Although the present invention has been shown and described with reference to the foregoing operational principles and preferred embodiments, it will be apparent to those skilled in the art that various changes in form and detail can be made without departing from the spirit and scope of the invention. The present invention is intended to embrace all such alternatives, modifications and variances. The subject matter of the present invention includes all novel and non-obvious combinations and subcombinations of the various elements, features, functions and/or properties disclosed herein. Inventions embodied in various combinations and subcombinations of features, functions, elements, and/or properties may be claimed through presentation of claims in a subsequent application.

I claim:

1. A packaging system comprising:

a receptacle having at least one opening to a compartment;

at least one collapsible panel coupled to the receptacle at a first location and adapted to be moved by a purchaser of the packaging system between an open configuration, in which the at least one collapsible panel is substantially adjacent the first location and collapsed against the receptacle, and a closed configuration, in which the at least one collapsible panel is extended across the at least one opening and reversibly coupled to the receptacle at a second location; and a substantially transparent disposable cover adapted to enclose the receptacle and the at least one collapsible panel while the at least one collapsible panel is in its open configuration.

2. The packaging system of claim 1, wherein the receptacle includes multiple compartments each having an opening.

3. The packaging system of claim 2, wherein the openings are located on one side of the receptacle.

4. The packaging system of claim 2, further comprising multiple said collapsible panels adapted to extend across the openings to the multiple compartments.

5. The packaging system of claim 2, wherein the collapsible panel is adapted to incrementally extend across the multiple openings.

6. The packaging system of claim 2, wherein the multiple compartments are separated by one or more removable inserts.

7. The packaging system of claim 1, wherein the receptacle includes a drawer.

8. The packaging system of claim 1, further comprising a fastening mechanism adapted to removably couple the collapsible panel to the receptacle at the second location.

9. The packaging system of claim 1, wherein the collapsible panel is configured to fold.

10. The packaging system of claim 1, wherein the at least one collapsible panel is biased to the open configuration.

11. The packaging system of claim 1, wherein the substantially transparent disposable cover is adapted to permit the purchaser to view the interior of the receptacle while enclosing the receptacle and the at least one collapsible panel is in its open configuration.

12. The packaging system of claim 1, wherein the collapsible panel is creased between multiple segments and the segments are configured to fold against one another in alternating directions.

13. A packaging system comprising:

a receptacle having at least one compartment with an opening;

a multi-segmented panel coupled to the receptacle at a first side and adapted to be moved by a purchaser of the packaging system between an open configuration in which the opening is accessible and the panel is folded and collapsed against the receptacle and a closed configuration in which the panel is extended across the opening and reversibly coupled to the receptacle at a second side; and a substantially transparent disposable cover adapted to enclose the receptacle and the multi-segmented panel while the multi-segmented panel is in its open configuration.

14. The packaging system of claim 13, further comprising a fastening mechanism adapted to reversibly couple the panel to the receptacle at the second side.

15. The packaging system of claim 14, wherein the fastening mechanism includes a hook-and-loop closure.

16. The packaging system of claim 13, further comprising a handle coupled to the receptacle.

17. The packaging system of claim 13, wherein the panel is integrally formed with a portion of the receptacle.

18. The packaging system of claim 13, wherein the panel is creased between the multiple segments and the segments are configured to fold against one another in alternating directions.

19. The packaging system of claim 13, wherein the panel is adapted to incrementally extend across the opening.

* * * * *

UNITED STATES PATENT AND TRADEMARK OFFICE

CERTIFICATE OF CORRECTION

PATENT NO. : 7,650,996 B2
APPLICATION NO. : 11/438937
DATED : January 26, 2010
INVENTOR(S) : Michelle Mark It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 584 days.

Signed and Sealed this

Twenty-third Day of November, 2010

David J. Kappos

David J. Kappos
*Director of the United States Patent and Trademark Office*